US008782957B2

(12) United States Patent
Luchsinger et al.

(10) Patent No.: US 8,782,957 B2
(45) Date of Patent: Jul. 22, 2014

(54) FOLDABLE PNEUMATIC SUPPORT

(75) Inventors: Rolf Luchsinger, Seegräben (CH); Rene Crettol, Reinach (CH)

(73) Assignee: Prospective Concepts AG, Dietikon (CH)

( * ) Notice: Subject to any disclaimer, the term of this patent is extended or adjusted under 35 U.S.C. 154(b) by 343 days.

(21) Appl. No.: 12/743,510

(22) PCT Filed: Nov. 10, 2008

(86) PCT No.: PCT/CH2008/000473

§ 371 (c)(1),
(2), (4) Date: Aug. 20, 2010

(87) PCT Pub. No.: WO2009/065238

PCT Pub. Date: May 28, 2009

(65) Prior Publication Data

US 2010/0307071 A1 Dec. 9, 2010

(30) Foreign Application Priority Data

Nov. 19, 2007 (CH) ..... 1781/07

(51) Int. Cl.
*E04B 1/34* (2006.01)

(52) U.S. Cl.
USPC ..... 52/2.13; 52/2.18; 52/2.11

(58) Field of Classification Search
USPC ..... 52/2.11, 2.13, 2.18, 2.19, 2.21
See application file for complete search history.

(56) References Cited

U.S. PATENT DOCUMENTS

| | | | | |
|---|---|---|---|---|
| 3,247,627 | A * | 4/1966 | Bird | 52/2.19 |
| 7,836,636 | B2 * | 11/2010 | Luchsinger | 52/2.11 |
| 2002/0157322 | A1 * | 10/2002 | Pedretti | 52/2.13 |
| 2006/0260209 | A1 * | 11/2006 | Pedretti | 52/2.11 |
| 2006/0273233 | A1 * | 12/2006 | Pedretti et al. | 248/560 |
| 2008/0185494 | A1 * | 8/2008 | Luchsinger et al. | 248/562 |
| 2010/0011674 | A1 * | 1/2010 | Crettol et al. | 52/2.11 |
| 2012/0061516 | A1 * | 3/2012 | Breuer et al. | 244/123.11 |

FOREIGN PATENT DOCUMENTS

| | | | |
|---|---|---|---|
| WO | WO 2005007991 | A1 * | 1/2005 |
| WO | WO-2006/000159 | A1 | 1/2006 |
| WO | WO-2006099764 | A1 | 9/2006 |
| WO | WO-2007071101 | A1 | 6/2007 |

OTHER PUBLICATIONS

Clasing, Martina, "International Search Report" for PCT/CH2008/000473, as mailed Nov. 5, 2009, (6 pages).

* cited by examiner

*Primary Examiner* — Branon Painter
(74) *Attorney, Agent, or Firm* — Winstead PC

(57) ABSTRACT

The invention relates to a pneumatic support (1) which can be folded together as a result of joints (10) in the pressure member (3) and has a flexible web (12) that is connected to the tractive member (4) over the entire length of the latter and is connected to the pressure member (3) only in the region of the joints of said member (10). This allows the joints (10) to be fixed in such a way that the pressure member (3) does not buckle at the site of the joints and thus remains stable.

12 Claims, 3 Drawing Sheets

FOLDABLE PNEUMATIC SUPPORT

Figure 1A:
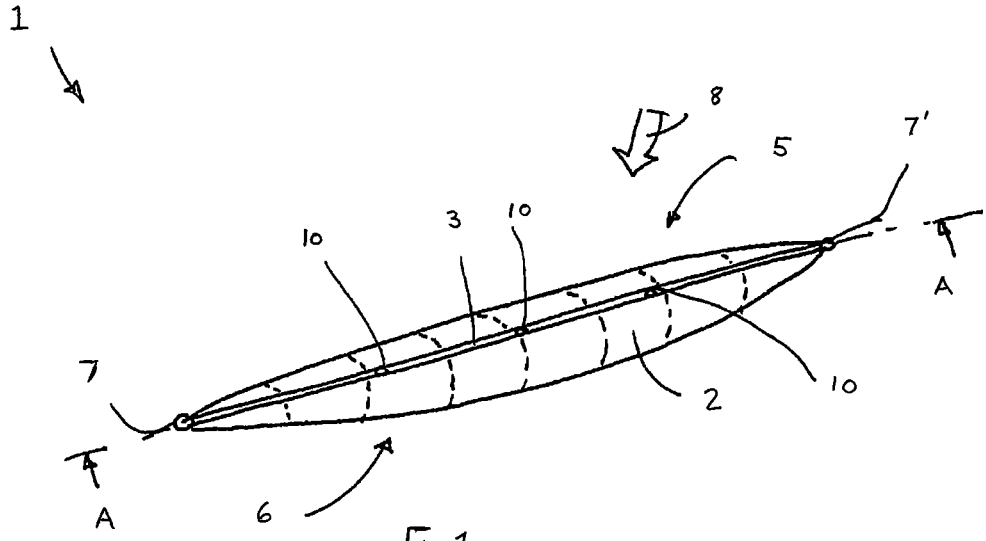

The present invention relates to a support for receiving a load according to the preamble of claim 1.

An elongate support which is stressed lengthwise, i.e. is subjected to bending stress, undergoes a deformation, wherein the neutral fibres divide the support into a pressure zone and into a tension zone.

Pneumatic supports of the type specified initially possess an elongate inflatable base body which is assigned a pressure member on one side and a tension member on the other side, wherein these members are held at a distance by the inflated base body. Under bending stress, the pressure member functionally absorbs the compressive loading and the tension member functionally absorbs the tensile loading, which on the one hand requires that the pressure member is pressure-resistant, i.e. also kink-resistant and that the tension member can be subjected to tensile stressing and on the other hand, allows the pressure member to be designed only for pressure and the tension member only for tension. This also includes the fact that the support is designed in such a manner that under the envisaged loading the neutral fibres run between compressive member and tensile member, i.e. through the inflatable base body. Pressure member and tension member are advantageously connected at the ends of the support in a node, wherein the nodes can at the same time form the bearing points for the support.

One advantage of such supports is that compared to their stiffness (loading capacity), they have only a low mass. In addition, as a result of the low mass they are fundamentally easy to transport also because the inflatable base body occupies little volume when folded together.

A disadvantage of the structure of a pneumatic support described is that load can fundamentally only be absorbed in a predetermined direction; in addition, depending on the configuration of the inflatable base body, restrictions are obtained in the guidance of the tension member or in the combination of the supports to give a compound structure such as a roof, a wall, a bridge etc.

Accordingly, various embodiments of pneumatic supports have become known which possess different properties.

WO 2007/071101 discloses an embodiment in which pressure and tension members are received by a flexible web which passes longitudinally through the cylindrical or spindle-shaped base body and constricts this to some extent at the same time, which improves the kink behaviour of the pressure member.

WO 2006/000159 discloses, inter alia, a pneumatic support which has improved transportability and for this purpose has a pressure member which can be folded together, i.e. is less cumbersome to transport. Disadvantages arise inter alia from the complex structure of the foldable pressure member which must be locked in its folding joints for operation but fairly large loads should be able to be absorbed by the support with good operating safety.

Accordingly, it is the object of the present invention to provide a pneumatic support which has an improved foldability, that is, allows easy assembly.

In order to achieve this object, the support according to the invention has the features of claim 1.

By using a web which fixes the joints of the pressure member in the operational position, there is no need to provide any locking for the joints at larger loads in the manner of WO 2006/000159. Assembly is thereby made easier as far as a design in which assembly can be carried out without any manipulation at the joints.

In addition, joints which can be pivoted not merely on one side can be provided, which allows optimal folding of the pressure member, i.e. to form a package having small dimensions.

Beyond the formulated object, such a pneumatic support is not only suitable for receiving uniformly distributed symmetrical, but also asymmetric loads.

The invention is explained in detail hereinafter with reference to the figures.

In the figures:

FIG. 1*a* shows a view of a pneumatic support according to the invention

Figure 1B:
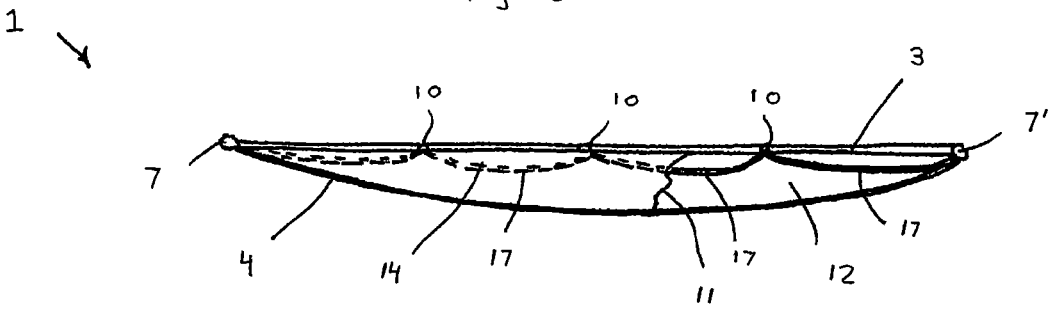

FIG. 1*b* shows a longitudinal section through the support from FIG. 1*a*

Figure 1C:
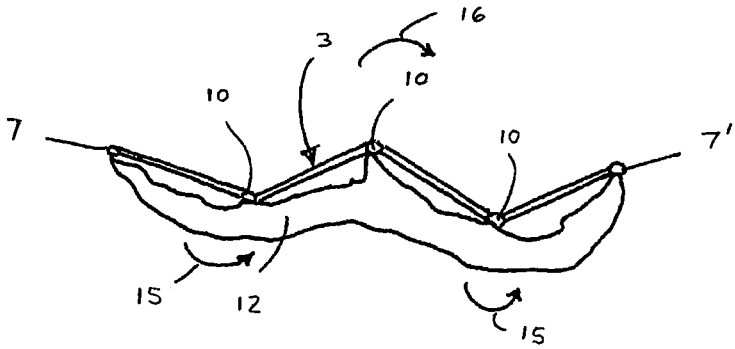
Figure 2:
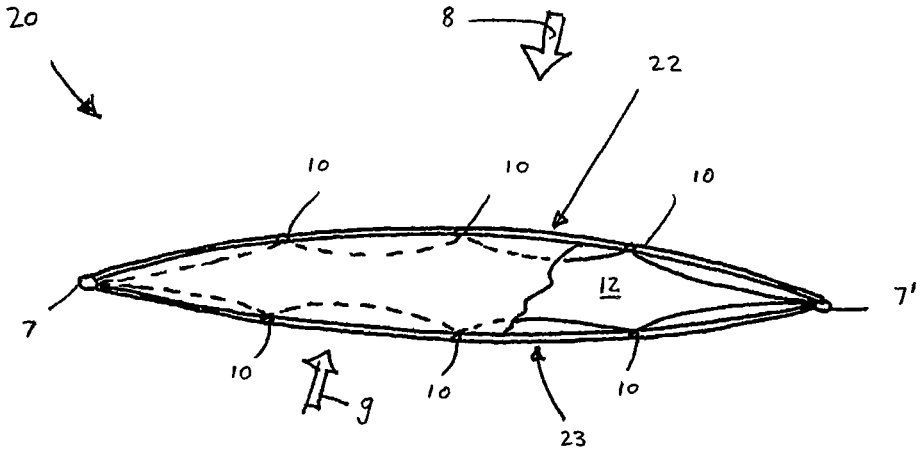
Figure 3A:
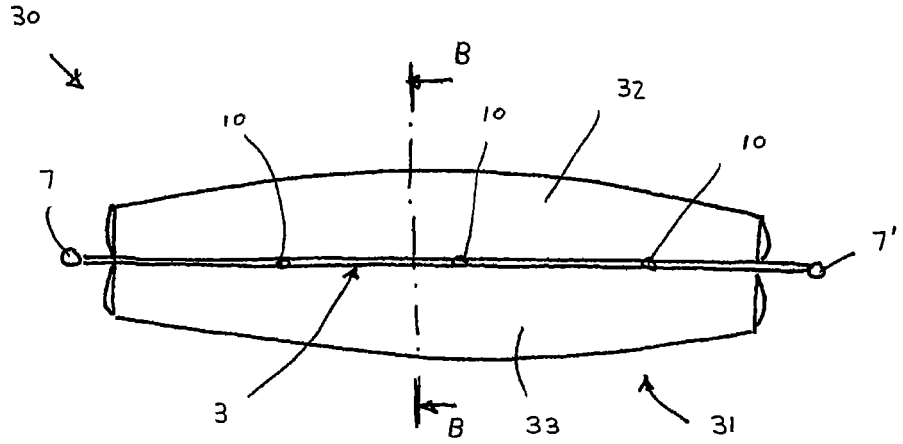
Figure 3B:
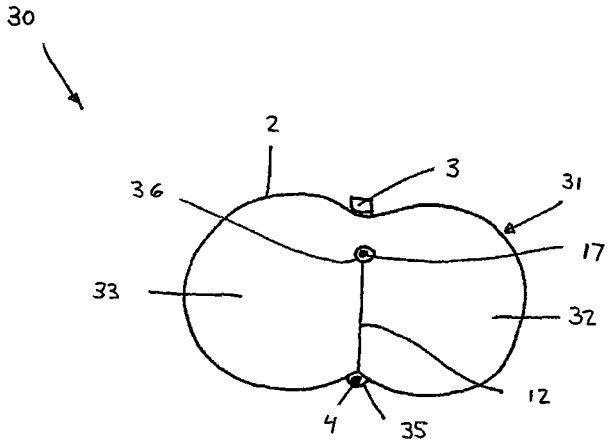

FIG. 1*c* shows the support from FIGS. 1*a* and *b*, half folded together, FIG. 2 shows a longitudinal section through a further embodiment of the support according to the invention, FIG. 3*a* shows a view of a second embodiment of the support according to the invention from above FIG. 3*b* shows a cross-section through the support from FIG. 3*a* and FIG. 3*b* shows a longitudinal section through the support from FIG. 3*a*.

FIG. 1*a* shows a pneumatic support 1 comprising an elongate, inflated base body 2 whose contours are indicated by dashed lines. Assigned to the base body 2 on one side is a pressure member 3 in the form of a slim beam and on the other side a tension member 4 (FIG. 1*b*); the pressure member 3 lies on the upper side 5 of the base body 2, runs longitudinally to this and is supported thereby whilst the tension member 4 runs longitudinally along its underside 6 (and can be multiply guided). The tension member 4 is preferably configured as a cable. In other words, pressure member 3 and tension member 4 are held at a distance by the base body 2.

Pressure member 3 and tension member 4 are connected to one another in nodes 7, 7' which are arranged at the ends of the support 1.

When the support 1 is exposed to a load symbolised by the arrow 8, the pressure member 3 is subjected to compressive stress and the tension member 4 is subjected to tensile stress, wherein the pressure member 3 is held in position by the base body 4 and is supported against kinks, and the tension member 4 is also held in position by the base body 2.

The pressure member 3 furthermore has joints 10 which allow it to be folded together. As a result, the support 1 can be packed in a small space for storage or for transport, by releasing the air from the base body and then rolling this together with the tension member 4 or separately from said member. The pressure member 3 is likewise folded together and for this purpose (or according to the dimensions of the support 1) can contain one or preferably a larger number of joints 10.

The support 1 can therefore be completely folded together on the one hand without needing to be dismantled and on the other hand can also be packed after dismantling, e.g. by rolling up the base body around the folded-together pressure member.

By the nature of the matter, joints 10 per se are undesirable in the loaded support 1 since under loading by the load 8 at the location of the joints 10, the pressure member 3 can buckle if it is not stable.

FIG. 1*b* shows the support from FIG. 1*a* viewed from the side, wherein this is partially cut away along a line of intersection 11. In the cutaway region, a longitudinal section can be seen through the support along the line AA from FIG. 1*a*. Shown there is a flexible web 12 which passes through the base body 2 longitudinally from node 7 to node 7' (and indicated by the dashed line 14 in the non-cutaway region). The web 12 can consist of a, for example, textile fabric such as is used for forming the base body 2 or of another suitable material; it is preferably formed continuously but can also be provided with reinforcements or recesses depending on the stressing. The web 12 connects the pressure member 3 to the tension member 4; according to the preferred embodiment shown in the figure, said web is connected to the pressure member 3 at the location of its joints 10 and to the tension member 4 substantially uninterruptedly over its entire length.

The web 12 is also operatively connected to the base body 2, here on the one hand via the pressure member 3 and on the other hand via the tension member 4 which both rest on the base body. When operating pressure prevails in the base body 2, the pressure member 3 and the tension member 4 are pressed apart by this and the web 12 is thereby stretched with the result that the web 12 which is then under tensile stress determines the maximum distance of pressure member 3 and tension member 4.

WO 2007/071101, reference being made here to its entire disclosure, discloses various embodiments for the configuration of such connections which the person skilled in the art can suitably implement when executing the present invention.

In a preferred embodiment, a fastening member is provided which, fixed on the web 12, connects this to the pressure member 3. In the figure, the fastening member is configured flexibly as cable 17 which is, for example, sewn at the edge to the web 12 over its length (or runs in a tab, see FIG. 3*b*) and which is then connected to the joints 10 (i.e. to the pressure member 3). The cable 17 therefore acts as reinforcement for the web 12 so that the forces acting on the web 12 at certain points through the joints 10 can then be suitably introduced into said web.

Since the web 12 is connected to the tension member 4 substantially over its entire length, the tension caused by the internal pressure in the web 12 is introduced uniformly into the tension member 4 (or the base body 2); any deformation of the tension member 4 which does not destroy but diminishes the supporting behaviour of the support 1 due to local introduction of tension is eliminated. The person skilled in the art can optimise the contour of the web 12 in this respect and adapt to the contour of the base body 2 under operating pressure and loaded as prescribed.

On the other hand, the tension in the web 12 caused by the internal pressure is concentrated on the side of the pressure member 3 in its joints 10 since the web 12 is only connected to these joints and thus only introduces the corresponding forces into these joints. The joints 10 are thereby fixed by the web in their operational position on the base body so that collapse of the support 1 due to buckling of the pressure member 3 at the location of the joints 10 is avoided.

Here it is understood that for this purpose the web 12 need not necessarily act on the joint 10 itself but can also act in the region of a joint 10, thus for example at the ends of the sections of the pressure member 3 connected to a joint 10. In this sense, it is also feasible that the web 12 can be continuously connected to the pressure member 3 as long as it is configured in such a manner that in the case of loading, the forces exerted by the web 12 on the pressure member 3 are concentrated in the region of the joint 10 and do not act uniformly on the pressure member 3 over the entire length.

In summary, it is found that, according to the invention, the forces exerted by the web 12 on the tension member 4 should be introduced as uniformly as possible into said member (so that its "natural" contour is not changed when loaded) whereas the forces exerted on the pressure member must act at points in the region of the joints 10.

Due to this configuration of the web 12, on the one hand the support 1 can easily be folded together without needing to be dismantled since the flexible web and also the flexible tension member 4 can be adapted to the folded-together pressure member 3. During inflation this configuration erects itself operationally which keeps the assembly expenditure low.

On the other hand, this arrangement is particularly advantageous under asymmetric loading.

Symmetric load distribution, i.e. a load acting uniformly distributed from node 7 to node 7' results in a symmetrical bending line only curved in one direction. Locking the joints 10 in accordingly only one pivoting direction (see the description to FIG. 1*c* and for example, WO 2006/000159) could be sufficient per se to maintain the stable position of the pressure member 3, i.e. to prevent buckling of the pressure member 3 corresponding to the bending line at the location of the joints 10.

According to the invention, this is achieved substantially more simply and in an improved manner by the arrangement and configuration of the web 12.

In the case of an asymmetric load distribution, locking of the joints in only one pivoting direction is no longer sufficient since the bending line then likewise runs asymmetrically and can be curved in both directions which leads to collapse of the support if the locking is only in one direction. Accordingly, it is then necessary to lock the joints in both pivoting directions which further increases the constructive effort and the assembly effort.

As a result of the joints 10, which are pivotable on both sides, being fixed according to the invention by means of the web 12, asymmetric loading of the support is also possible without incurring increased constructive effort.

FIG. 1*c* shows a longitudinal section through the support 1 along the line AA from FIG. 1*a*, wherein only the web 12 with the pressure member 3 and the tension member 4 (without base body 2) can be seen. A moment in which the support 1 is folded together (or inflated) is shown. The two outer joints 10 are pivoted in one pivoting direction according to the arrow 15 and the middle joint 10 is pivoted in the other pivoting direction according to the arrow 16. As a result, the sections of the pressure member 3 connected by the joints 10 can rest parallel to one another when folding together.

FIG. 2 shows another embodiment of a pneumatic support 20 according to the invention in which both the pressure member and also the tension member can equally absorb compressive and tensile loading. A tension/pressure member 22 and a tension/pressure member 23 are provided instead of the pressure member 3 and the tension member 4 according to FIGS. 1*a* to 1*c*. In other words, the pressure member and the tension member are configured to be mirror images. This allows load to be absorbed both from above (load according to arrow 8) and from below (load according to arrow 9), therefore on both sides. Pneumatic supports of this type are fundamentally known but not in a foldable configuration.

According to the invention, the web 12 is now arranged and configured in such a manner that in the inflated state of the base body, it fixes all the joints 10 of both members 22, 23 in an operational position. In the case of loading by a load according to arrow 8, the tension/pressure member 22 absorbs the pressure at some point as described in connection with FIGS. 1*a* and *b*. The tension/pressure member 23 only absorbs tension. However, since it is also pressure-loadable, it possesses pressure rod sections connected by joints 10 which are stiff; it is therefore sufficient here if the web 12 only introduces the forces transmitted by it into the region of the joints 10; the load-bearing capacity of the support 1 is not diminished as would be the case if a flexible tension member 4 (FIG. 1*b*) were to appear in place of the tension/pressure member 23. This also applies conversely for a load acting from below according to arrow 9.

In the present case, the web 12 is configured without reinforcing cables arranged at the edge (cable 17 from FIG. 1*b*). Depending on the configuration of the support, the person skilled in the art may or may not provide such reinforcements in suitable form.

FIG. 3*a* shows a further embodiment of the invention, i.e. a support 30 configured according to WO 2007/071101 viewed from above. Reference is expressly made here to the total disclosure of WO 2007/071101. The nodes 7, 7' as well as the pressure member 3 with its joints 10 can be seen.

The base body 31 is configured as a spindle which is constructed longitudinally by the web under operating pressure. It is also possible to configure the base body 31 as a cylinder which is constricted longitudinally by the web. Half-chambers 32, 33 are formed in the base body 31 due to the constriction.

FIG. 3*b* shows the support 30 from FIG. 3*a* in cross-section along the line BB from FIG. 3*a* with the pressure member 3, the tension member 4 and the web 12. The half-chambers 32, 33 are longitudinally penetrated by the web 12.

The pressure member 3 lies on the base body 2 at the location of the constriction caused by the web 12. Likewise the tension member 4 which is protected here from lateral slippage or from external influences (weather, dirt etc.) by a, for example, sewn-on pocket 35. Such a pocket, although not shown in the figure, can naturally also be provided for the pressure member 3.

Also shown is the cable 17 which here runs in a pocket which is sewed on or fastened in another suitable manner to the edge of the web 12.

Figure 3C:
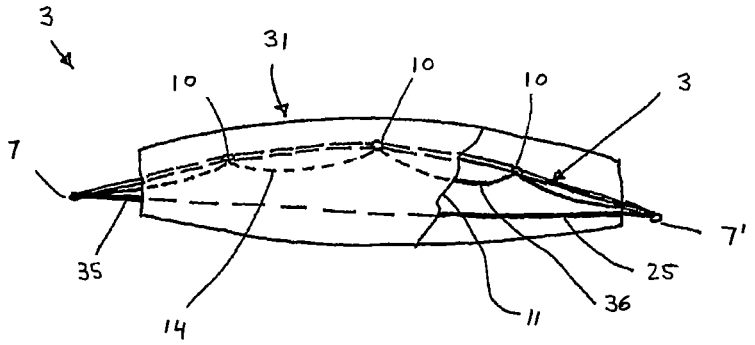

FIG. 3*c* shows the support 30 viewed from the side wherein the base body 31 is partially cut away along the line of intersection 11. In turn, the web 12 is arranged and configured in such a manner that it introduces the forces transmitted by it into the region of the joints 10 on the side of the pressure member 3 and distributed as uniformly as possible on the side of the tension member 4. The covered part of the web 12 is indicated by the dashed line 14.

Here, the pressure member 3 is configured as upwardly curved but can also run straight (FIG. 1) or be bent downwards as long as it runs in the pressure zone with respect to the neutral fibre of the loaded support 30 and the tension member accordingly in the tensile zone.

The support 30 can easily be configured similarly to that from FIG. 2, i.e. it can contain two tension/pressure members connected by the web 12 so that it can be loaded both from above and from below.

The joints 10 are preferably configured as simple pivoting joints whose pivot axis runs perpendicular to the pressure member 3 and, in the inflated state of the base body 2, to the web 12.

The pneumatic supports 1, 20 and 30 described can be combined to form a compound structure, e.g. a roof, a wall or a bridge.

The load symbolised by the arrows 8, 9 can act directly on the pressure member 3 (or tension/pressure member 22, 23) or be introduced into said member by means of suitable connecting members. It is also possible to introduce the load into the web 12 directly or via connecting members as described in WO 2007/071101.

The invention claimed is:

1. A pneumatic support for receiving a load, the pneumatic support comprising:

an inflatable, elongate base body;

a pressure member having at least one joint;

at least one tension member;

wherein the pressure member and the at least one tension member run longitudinally along the inflatable, elongate base body and are connected to one another at respective ends of the pneumatic support in a node;

a flexible web, wherein the flexible web passes longitudinally through the inflatable, elongate base body and is stretched upon inflation of the inflatable, elongate base body; and wherein the flexible web connects the pressure member and the at least one tension member operatively to one another, in a substantially linear fashion, and fixes the at least one joint of the pressure member in an operational position when the inflatable, elongate base body is inflated.

2. The pneumatic support according to claim 1, wherein the flexible web is connected to the pressure member in a region of the at least one joint.

3. The pneumatic support according to claim 1, wherein the flexible web is connected to the at least one tension member substantially uninterruptedly over an entire length of the at least one tension member.

4. The pneumatic support according to claim 1, wherein the flexible web is connected to the pressure member by a fastening member fixed on the pressure member.

5. The pneumatic support according to claim 1, wherein the inflatable, elongate base body is configured as a cylinder and is longitudinally constricted by the flexible web under operating pressure.

6. The pneumatic support according to claim 1, wherein the inflatable, elongate base body is configured as a spindle and is longitudinally constricted by the flexible web under operating pressure.

7. The pneumatic support according to claim 1, wherein a joint axis of the at least one joint is arranged perpendicular to the pressure member and perpendicular to the flexible web.

8. The pneumatic support according to claim 1, wherein the at least one joint is configured such that segments of the pressure member are generally parallel to one another when the pressure member is in a folded position.

9. The pneumatic support according to claim 1, wherein:

the at least one tension member comprises at least one second joint;

the pneumatic support receives a load which stresses the at least one tension member under pressure and the pressure member under tension; and in an inflated state of the inflatable, elongate base body, the at least one second joint of the at least one tension member is fixed in the operational position by the flexible web.

10. The pneumatic support according to claim 1, wherein the at least one tension member is configured as a cable.

11. A pneumatic structure comprising: a first pneumatic support for receiving a load, the first pneumatic support comprising:

a first inflatable, elongate base body;

a first pressure member having at least one first joint;

at least one first tension member;

wherein the first pressure member and the at least one first tension member run longitudinally along the first inflatable, elongate base body and are connected to one another at respective ends of the first pneumatic support in a first node;

a first flexible web, wherein the first flexible web passes longitudinally through the first inflatable, elongate base body and is stretched upon inflation of the first inflatable, elongate base body; and wherein the first flexible web connects the first pressure member and the at least one first tension member operatively to one another, in a substantially linear fashion, and fixes the at least one first joint of the first pressure member in an operational position when the first inflatable, elongate base body is inflated; and a second pneumatic support for receiving a load, the second pneumatic support comprising:

a second inflatable, elongate base body;

a second pressure member having at least one second joint;

at least one second tension member;

wherein the second pressure member and the at least one second tension member run longitudinally along the second inflatable, elongate base body and are connected to one another at respective ends of the second pneumatic support in a second node;

a second flexible web, wherein the second flexible web passes longitudinally through the second inflatable, elongate base body and is stretched upon inflation of the second inflatable, elongate base body; and wherein the second flexible web connects the second pressure member and the at least one second tension member operatively to one another, in a substantially linear fashion, and fixes the at least one second joint of the second pressure member in an operational position when the second inflatable, elongate base body is inflated.

12. The pneumatic structure of claim 11, wherein the pneumatic structure is an inflatable bridge.

* * * * *